US006041466A

United States Patent [19]

Payton, Jr.

[11] Patent Number: 6,041,466

[45] Date of Patent: Mar. 28, 2000

[54] SCOURING PAD HOLDER

[75] Inventor: Martin J. Payton, Jr., Blue Bell, Pa.

[73] Assignee: Precision Metal Services, Inc., Colmar, Pa.

[21] Appl. No.: 09/004,769

[22] Filed: Jan. 9, 1998

[51] Int. Cl.[7] ..... A47L 13/12

[52] U.S. Cl. ..... 15/105; 15/229.11; 15/229.13; 15/236.01; 15/236.08; D4/137

[58] Field of Search ..... 15/105, 209.1, 15/229.11, 229.12, 229.13, 111, 236.01, 236.08; D4/137, 118; D32/42

[56] References Cited

U.S. PATENT DOCUMENTS

| | | |
|---|---|---|
| D. 349,193 | 8/1994 | Sloan et al. . |
| 1,921,921 | 8/1933 | Harvie . |
| 1,928,111 | 9/1933 | Mednick . |
| 2,555,153 | 5/1951 | Rakoff et al. . |
| 3,094,728 | 6/1963 | White . |
| 3,199,139 | 8/1965 | Vallis . |
| 5,317,779 | 6/1994 | Hoagland . |

*Primary Examiner*—Robert J. Warden, Sr.
*Assistant Examiner*—Jennifer McNeil
*Attorney, Agent, or Firm*—Joseph W Molasky & Associates

[57] ABSTRACT

A holder for removably engaging a scouring pad (such as stainless steel) includes a handle and an apertured end portion. A scouring pad is inserted through the bottom of the apertured end portion and held in place by a top flanged surface formed in the apertured end portion. Although held securely, the pad may be easily removed after use. A plurality of stiffening ribs may be included around the inner periphery of the end portion's encasing sidewall to increase its rigidity. Retaining wedges may also be disposed around the bottom perimeter of the apertured end portion to urge the scouring pad upwards and maintain its engagement with the top flange portion. A scraper end may be attached to the top flanged end of the apertured end portion, if desired.

17 Claims, 2 Drawing Sheets

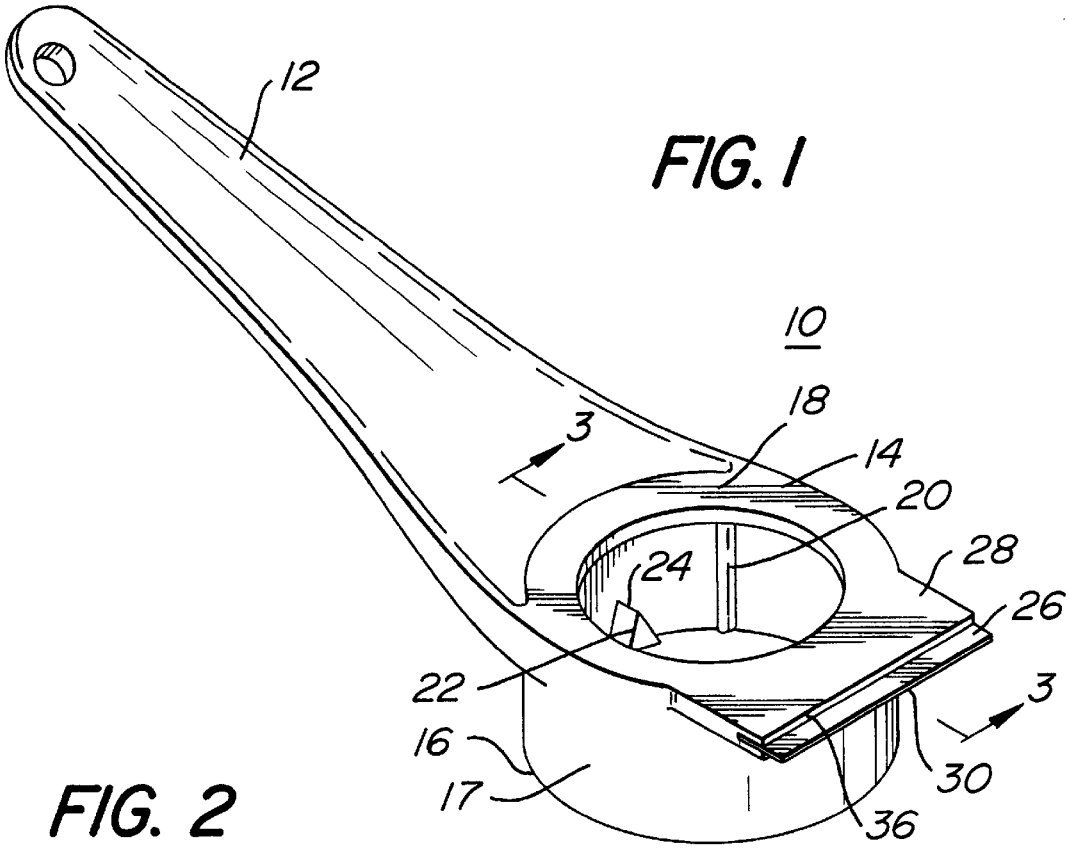
FIG. 1
FIG. 2
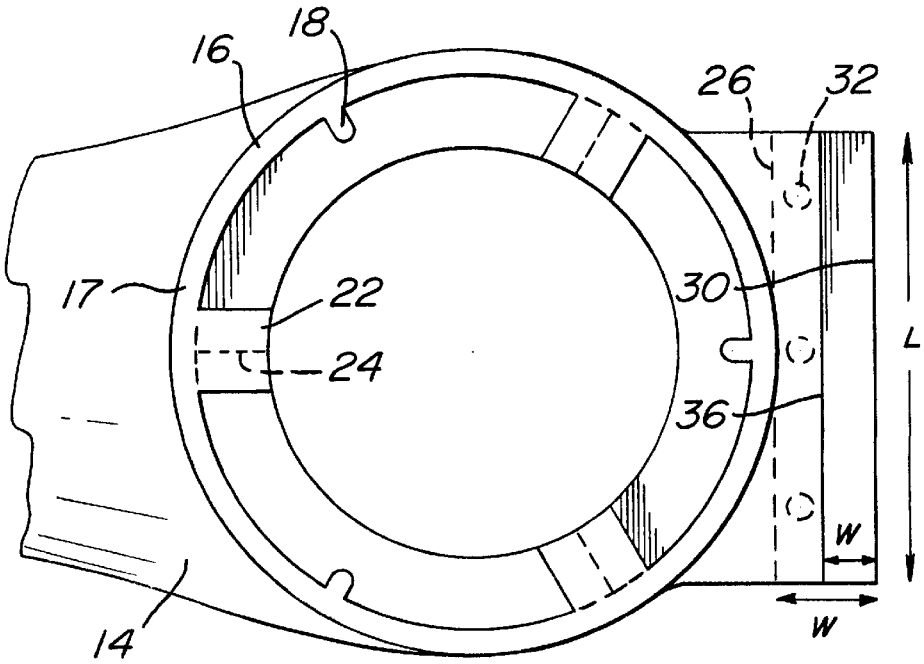

SCOURING PAD HOLDER

BACKGROUND OF THE INVENTION

1. Field of the Invention

The present invention relates to a scouring pad holder and, more particularly, to a holder for removably engaging a scouring pad, such as a stainless steel pad.

2. Description of the Prior Art

It is very common to use scouring pads, such as stainless steel, to aid in cleaning pots and pans. In the conventional use of such pads, the pad is held by hand. With extended use, the pad may become difficult to hold. Additionally, the hand or fingers, being so close to the scouring surface, may interfere with the cleaning operation.

SUMMARY OF THE INVENTION

The present invention relates to a scouring pad holder and, more particularly, to a holder for removably engaging a scouring pad to facilitate its use. The holder includes a first gripping end, or handle, for holding the device in one's hand and a second, apertured end for engaging a stainless steel pad, or similar scouring device. The apertured end allows for a scouring pad to be inserted from the rear of the holder so that a portion of the pad is exposed through the front of the holder. In one embodiment, the apertured end may be cylindrical in form, although many other geometries (square, triangular, octagonal, for example) are similarly suitable. A plurality of ribs are included as strengthening members around the sidewall perimeter of the apertured end. A plurality of wedge members may also be formed on the interior portion of the sidewall and may be disposed in an alternating pattern with the ribs. The wedges are oriented such that the triangular terminations extend upward toward the top opening of the apertured end portion. The wedges, when used, function to urge the scouring pad toward the front opening of the aperture and further secure the engagement of the pad within the holder.

In one embodiment, a plurality of gripping members, such as teeth, may be disposed around the inner perimeter of the top surface of the apertured end to aid in securing the scouring pad to the holder, while still allowing the pad to be removed and replaced with a fresh one, as desired. In another embodiment, a scraper edge may be added to the apertured end portion.

In manufacture, the holder may be formed from injection molded plastic, with the scraper edge comprising a metal piece part positioned within the mold and fixed in place by the injection molding process.

Other and further aspects of the present invention will become apparent during the course of the following discussion and by reference to the accompanying drawings.

BRIEF DESCRIPTION OF THE DRAWINGS

Referring now to the drawings,

FIG. 1 is an isometric view of an exemplary scouring pad holder formed in accordance with the present invention;

FIG. 2 is a partial view of the bottom surface of the holder of FIG. 1, illustrating in particular the details of the cylindrical end portion of the holder;

DETAILED DESCRIPTION OF THE PREFERRED EMBODIMENTS

Figure 3:
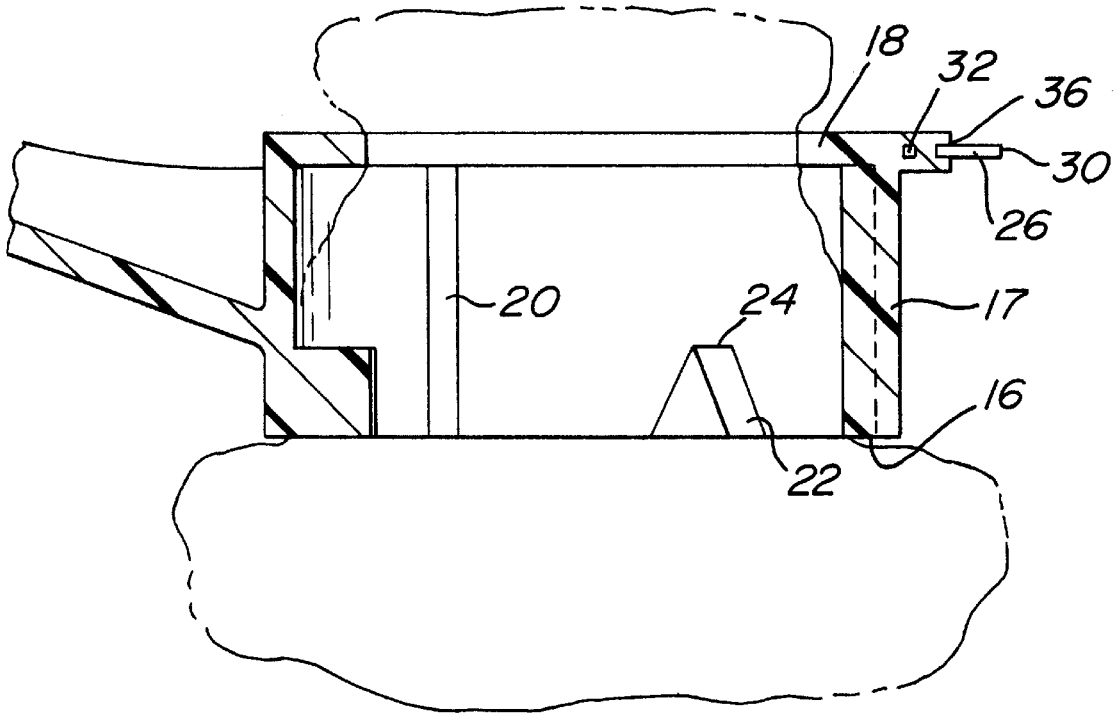
FIG. 3 is a cut-away side view of the scouring pad holder, taken along line 3—3 of FIG. 1 and illustrating, in phantom, a scouring pad disposed within the holder's cylindrical opening.

FIG. 1 contains an isometric view of an exemplary scouring pad holder 10 formed in accordance with the present invention. Holder 10 may be formed of plastic, or any other suitable material. If formed of plastic, holder 10 may be injection molded or similarly constructed. For the purposes of the present invention, the material composition of holder 10 is not a significant concern. Referring to FIG. 1, holder 10 includes a first, handle end 12 that is gripped when the holder is in use. Holder 10 also includes a second, apertured end portion 14 that holds the scouring pad (not shown in this view) in place. In accordance with the holder of the present invention, it is intended that a scouring pad is "removably engaged", since most scouring pads have a limited useful lifetime. It is a feature of the present invention that the replacement of a spent pad with a fresh one is a relatively easy process, yet the pad is held sufficiently secure during use so that the pad does not unintentionally drop out of the holder. It is to be understood that the apertured end portion of the inventive holder may comprise any desired geometry—triangular, square, octagonal, and circular are only a few of the various options. Therefore, during the course of the following discussion, the reference to a "cylindrical" end portion is considered to be exemplary only and other suitable geometries may be substituted and still fall within the spirit and scope of the present invention.

Referring to FIG. 1, an exemplary end portion 14 is illustrated as cylindrical in form and is defined as including a bottom surface 16 and a top, flanged surface 18 separated by a circular sidewall 17. When used, a scouring pad is inserted through bottom surface 16 and pushed into cylindrical end portion 14 until a suitable amount of the pad (about 10%) extends about top surface 18 (see FIG. 3). Rigidity may be added to cylindrical end portion 14 by including a plurality of stiffening ribs 20 disposed around the inner perimeter of sidewall 17 and extending between bottom surface 16 and top surface 18. To further improve the "fit" of a scouring pad within cylindrical end portion 14, a plurality of wedges 22 may be formed around the inner perimeter of sidewall 17, extending upward from bottom surface 16. The tip 24 of each wedge 22 thus act to force the scouring pad upward and urge contact between the scouring pad and top flanged surface 18 of cylindrical end portion 14.

An additional feature of the holder of the present invention may be to include a scraper edge 26 within an extension 28 disposed beyond cylindrical end portion 14. The scraper may comprise a metal piece part that is fixed in place during, for example, an injection molding process. The fixation of scraper 26 is discussed below in association with FIG. 2. Referring back to FIG. 1, scraper 26 may include a flat edge 30, or a serrated edge, the serrated edge being illustrated in FIG. 4. In general, the inclusion of such a scraper is considered optional but may be included to enhance the capabilities of the holder assembly.

A bottom view of cylindrical end portion 14 of holder 10 is illustrated in FIG. 2. In the illustrative embodiment of FIG. 2, a set of three stiffening ribs 20 is shown, as well as a set of three retaining force wedges 22. Ribs 20 are disposed in an equidistant relationship and wedges 22 are positioned to alternate with ribs 20. It is to be understood that the number and location of both ribs 18 and wedges 22 may be varied, as desired, with the preferred embodiment being that as shown in FIG. 2. However, depending upon the material used, four or five stiffening ribs may be needed to provide the required rigidity. Also illustrated in FIG. 2 is one exemplary means for attaching scraper 26 to holder 10. Presuming that holder 10 is formed using an injection molding process, scraper 26 may comprise a metal piece part of any desired length L and width W. A plurality of apertures 32 are formed in scraper 26 near a rear edge 34. As holder 10 is formed during an injection molding process, the molding material (i.e., plastic) will flow through apertures 32 and thereby fix the attachment of scraper 26 to holder 10. In the final product, edge 30 of scraper 26 will protrude beyond edge 36 of holder 26. The width, w', of final scraper 26 is at the discretion of the fabricator.

A cut-away side view of cylindrical end portion 14 of holder 10 is shown in FIG. 3, with a scouring pad outline, illustrated in phantom, included within holder 10. In particular, a scouring pad is inserted through bottom surface 16 of end portion 14 and urged upwards until a portion of the pad extends above flanged top surface 18 of end portion 14, as shown. As mentioned above, retaining wedges 22 may be included to aid in the retention of the scouring pad within end portion 14, yet allowing the pad to be removed after use. To remove the pad, the portion nearest end surface 16 is simply grabbed, and the pad pulled out of end portion 14.

Figure 4:
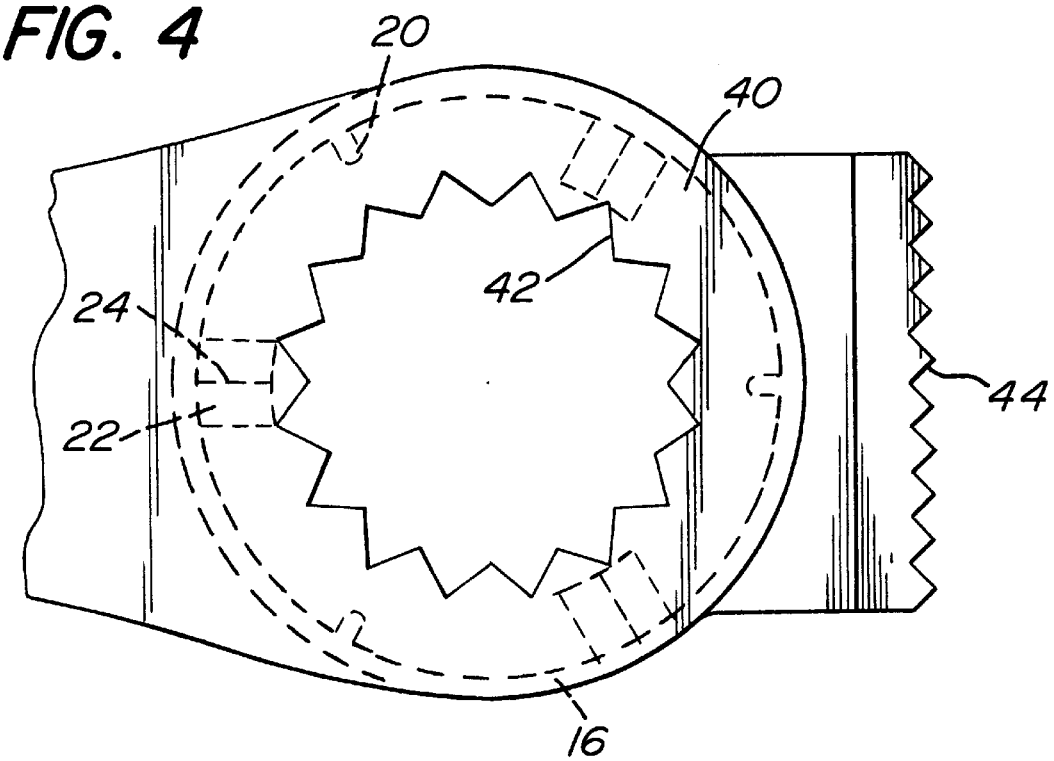
FIG. 4 is a partial view of an alternative embodiment of the present invention, including grabbing teeth disposed to surround the top opening of the cylindrical end portion.

To further aid in the retention of the scouring pad within the holder, flanged top surface 18 may be formed to include a number of "grabbing" teeth, disposed around the perimeter of surface 18 and extending toward the central region of end portion 14. FIG. 4 illustrates one particular embodiment of top surface 18 (the remaining components, illustrated in phantom, being identical to those discussed above) including grabbing teeth 40 disposed to completely surround the inner edge 42 of top surface 18. It is to be understood that any number of teeth may be used. Also illustrated in this particular embodiment is an alternative design for scraper 26, where straight edge 30, as shown in FIG. 2, is replaced with a serrated edge 44. Again, any suitable edge may be used.

Various other features and modifications of the present invention may be made and are considered to fall within the spirit and scope of the present invention as defined by the claims appended hereto. In particular, as stated above, the apertured end portion may comprise any suitable geometry triangular, square, octagonal, etc. The cylindrical representation as described and shown in the drawings is exemplary only and illustrated as a preferred embodiment; the cylindrical geometry is not to be considered as a limitation on the holder apparatus of the present invention.

What is claimed is:

1. A holder for removably engaging a scouring pad, the holder comprising a first, tapered end defining a handle for said holder, an apertured end portion disposed at the termination of said handle, the apertured end portion including a bottom edge defining an opening and a top, flanged opening, with an encasing sidewall disposed therebetween to form said end portion, wherein a scouring pad may be inserted through the bottom edge opening and held removably in place by the flanged top opening of the end portion, and a plurality of retaining wedges disposed on the encasing sidewall and attached to the bottom edge opening of said apertured end portion, said plurality of retaining wedges oriented such that a pointed edge of each wedge extends toward the top, flanged opening of said apertured end portion.

2. A holder as defined in claim 1 wherein the holder further comprises a plurality of stiffening ribs disposed on the encasing sidewall and extending between the bottom edge opening and the top flanged opening.

3. A holder as defined in claim 2 wherein the stiffening ribs are disposed equidistant from one another.

4. A holder as defined in claim 2 wherein a set of three stiffening ribs is used.

5. A holder as defined in claim 1 wherein the retaining wedges are disposed equidistant from one another.

6. A holder as defined in claim 1 wherein a set of three retaining wedges is used.

7. A holder as defined in claim 1 wherein the apertured end portion comprises a cylindrical form including a circular encasing sidewall.

8. A holder as defined in claim 1 wherein the holder further comprises a plurality of stiffening ribs disposed on the encasing sidewall and extending between the bottom edge opening and the top flanged opening; and a plurality of retaining wedges disposed around said encasing sidewall and attached to said bottom edge opening of said apertured end portion, said plurality of retaining wedges oriented such that a pointed edge of each wedge extends toward said top, flanged opening of said apertured end portion.

9. A holder as defined in claim 8 wherein the stiffening ribs and retaining wedges are disposed in an alternating pattern on the encasing sidewall.

10. A holder as defined in claim 9 wherein the stiffening ribs and retaining wedges are disposed equidistant from one another.

11. A holder as defined in claim 8 wherein a set of three stiffening ribs and a set of three retaining wedges are used.

12. A holder as defined in claim 8 wherein the apertured end portion comprises a cylindrical geometry including a circular encasing sidewall.

13. A holder as defined in claim 1 wherein the holder further comprises a scraping means attached to the apertured end portion in proximity to the flanged top opening.

14. A holder as defined in claim 13 wherein the scraping means comprises a metallic piece part attached to the apertured end portion.

15. A holder as defined claim 14 wherein the holder is formed of injection molded material and the metallic piece part includes a plurality of apertures for attaching said metallic piece part during an injection molding process.

16. A holder as defined in claim 1 wherein the flanged top opening of the apertured end portion includes a plurality of teeth formed around the inner periphery thereof, said plurality of teeth for contacting an associated scouring pad and aiding in the retention of said scouring pad within the apertured end portion.

17. A holder as defined in claim 16 wherein the plurality of teeth are formed to completely surround the entire inner periphery of the top flanged opening of the apertured end portion.

* * * * *